US005529110A

United States Patent [19]

Shimmell

[11] Patent Number: 5,529,110

[45] Date of Patent: Jun. 25, 1996

[54] ROTARY ACTUATED CLOSED SHOT DIE CASTING

[75] Inventor: Dennis S. Shimmell, Hudsonville, Mich.

[73] Assignee: Nelson Metal Products Corporation, Grandville, Mich.

[21] Appl. No.: 280,159

[22] Filed: Jul. 25, 1994

[51] Int. Cl.[6] ..... B22D 17/10; B22D 17/20

[52] U.S. Cl. ..... 164/113; 164/312

[58] Field of Search ..... 164/312, 313, 164/314, 315, 113

[56] References Cited

U.S. PATENT DOCUMENTS 5,199,480 4/1993 Schultz et al. ..... 164/312 X
5,205,338 4/1993 Shimmell .

FOREIGN PATENT DOCUMENTS 0373114 6/1990 European Pat. Off. .
461796 8/1975 U.S.S.R. ..... 164/312

*Primary Examiner*—J. Reed Batten, Jr.
*Attorney, Agent, or Firm*—Warner Norcross & Judd

[57] ABSTRACT

The system includes a shot sleeve having a bore and a transverse fill hole communicating with the bore. A closure member is rotatably mounted on the shot sleeve and defines a window. The closure member rotates between a fill position in which the window is aligned with the filling hole and a casting position in which the closure member seals the filling hole. Any excess molten material from the fill is poured from the closure member as it rotates. Preferably, the closure member is mounted eccentrically with respect to, and intersects, the bore. In this case, the closure member defines an arcuate recess that aligns with the internal bore when the closure member is in the casting position, thereby allowing the plunger to reciprocate through the internal bore.

11 Claims, 5 Drawing Sheets

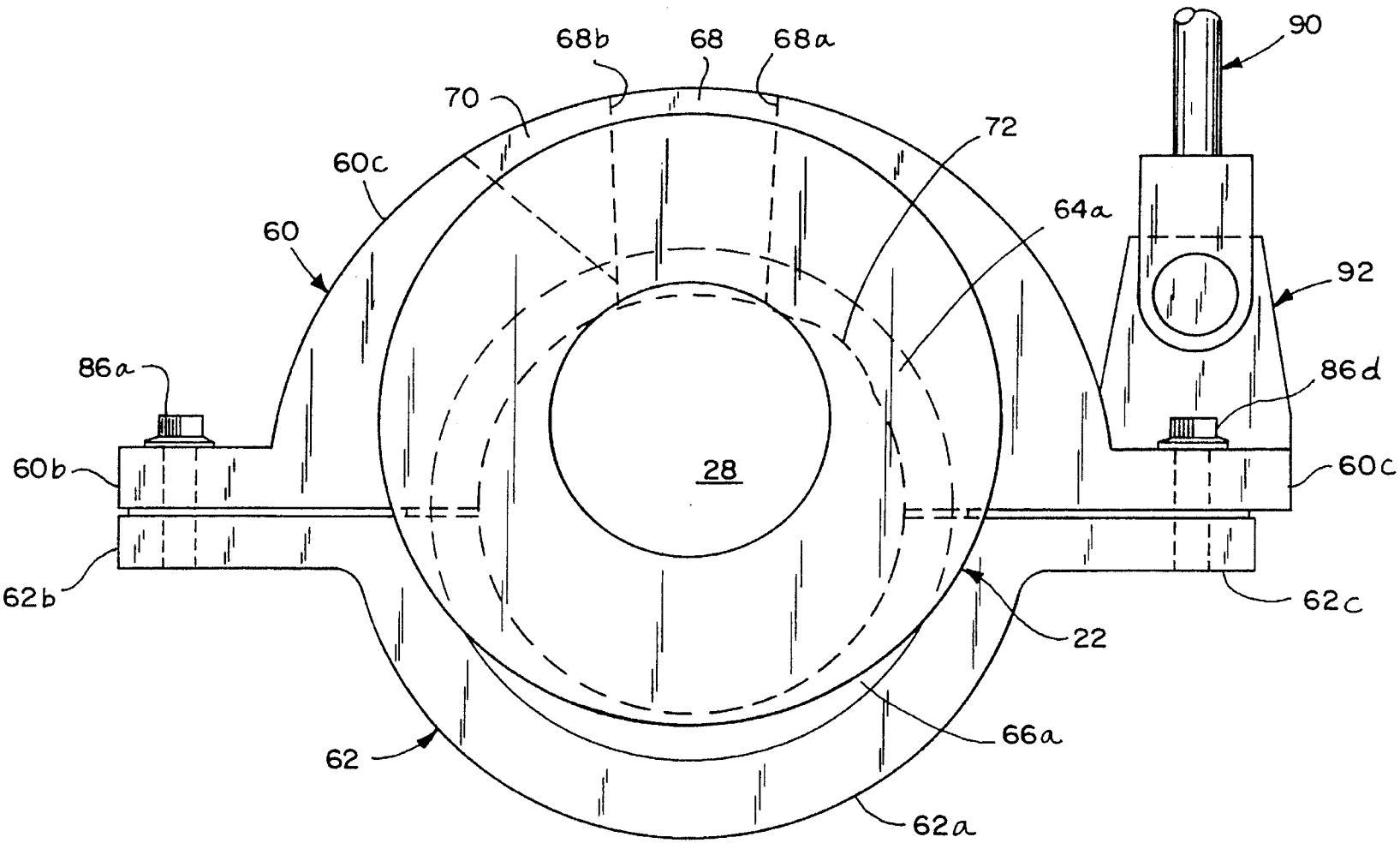
FIG. 6
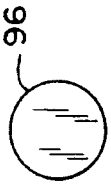

ROTARY ACTUATED CLOSED SHOT DIE CASTING

BACKGROUND OF THE INVENTION

The present invention relates to a method and apparatus for die casting molten material, and more particularly to a method and apparatus for injecting a shot of molten material into the cavity of a die.

Die casting is a well known technique for forming articles from molten metal. Typically, the die casting apparatus includes a pair of die halves each formed with a void corresponding to a portion of the article to be cast. When the two die halves are brought together in proper alignment, their respective voids cooperate to form a die cavity corresponding to the shape of the article to be cast. Molten material is introduced into the die cavity and allowed to cure. Generally, the curing process involves cooling the molten material to allow it to solidify. Once the material is sufficiently cured, the die halves are opened and the cast article is removed.

In the past, a shot cylinder has been used to inject the molten metal into the die cavity. The cylinder includes a shot sleeve defining an internal bore and a transverse filling opening to allow molten metal to be poured into the sleeve. Upon actuation, the cylinder plunger both seals off the transverse opening and injects the molten metal into the die cavity. The open filling hole presents problems because air can be trapped in the sleeve. If overfilled, the shot sleeve can pressurize before the plunger seals the filling hole and molten material can spurt back through the filling hole as the plunger advances. Even if the shot sleeve is filled properly to prevent spurting, air may be trapped within the sleeve and injected with the molten material into the die, resulting in a porous casting.

A unique closed shot die casting arrangement that overcomes these problems is disclosed in U.S. Pat. No. 5,025,338 issued Apr. 27, 1993 to Shimmell. The '338 patent discloses a filling cylinder that intersects the shot sleeve and includes a reciprocating slide valve. After the internal bore of the shot sleeve has been filled with molten material, the slide valve is actuated to seal off the filling opening in the shot sleeve. Consequently, the shot sleeve is completely filled and sealed prior to the advancement of the plunger. While a significant advance in the art, the described closed shot die casting arrangement of the '338 patent requires relative complex machining in its manufacture. Further, the filling cylinder increases the profile of the shot sleeve arrangement so that it cannot be included on all desirable die casting equipment.

SUMMARY OF THE INVENTION

The aforementioned problems are overcome by the present invention wherein a rotary actuated closed shot die casting system provides a relatively slim profile and is manufactured by relatively simple machining. Specifically, the system includes a shot sleeve defining a bore and a transverse filling hole. A rotating closure defining a window is mounted on the shot sleeve around the filling hole and is moveable between a fill position wherein the window and filling hole are aligned and a casting position wherein the window and filling hole are not aligned. In the fill position, the window in the closure is aligned with the filling hole to allow molten material to pass into the internal bore of the shot sleeve. Once filled, the closure is rotated around the shot sleeve to seal the filling hole and pour off any excess molten material.

In the disclosed embodiment, the rotatable closure is mounted in an annular recess that is eccentric with respect to the shot sleeve bore. When in the fill position, the closure prevents the plunger from traveling past the closure. When in the casting position, the closure defines a portion of the sleeve wall permitting the plunger to be actuated to force the molten metal into the die cavity. During manufacture, the cylinder bore is created with the closure in the cast position so that the portion of the sleeve wall defined by the closure is perfectly aligned with the remainder of the bore.

The present invention provides a simple and effective method for filling and sealing the internal bore of a shot sleeve while preventing the entrainment of air. The metal delivery system may be incorporated into both OEM (original equipment manufacturer) die casting equipment and existing systems. The system also has a relatively compact profile.

These and other objects, advantages, and features of the invention will be more fully understood and appreciated by reference to the detailed description of the preferred embodiment and the drawings.

BRIEF DESCRIPTION OF THE DRAWINGS

FIG. 6 is a front elevational view of the closure and shot sleeve in the fill position.

DETAILED DESCRIPTION OF THE PREFERRED EMBODIMENT

Figure 1:
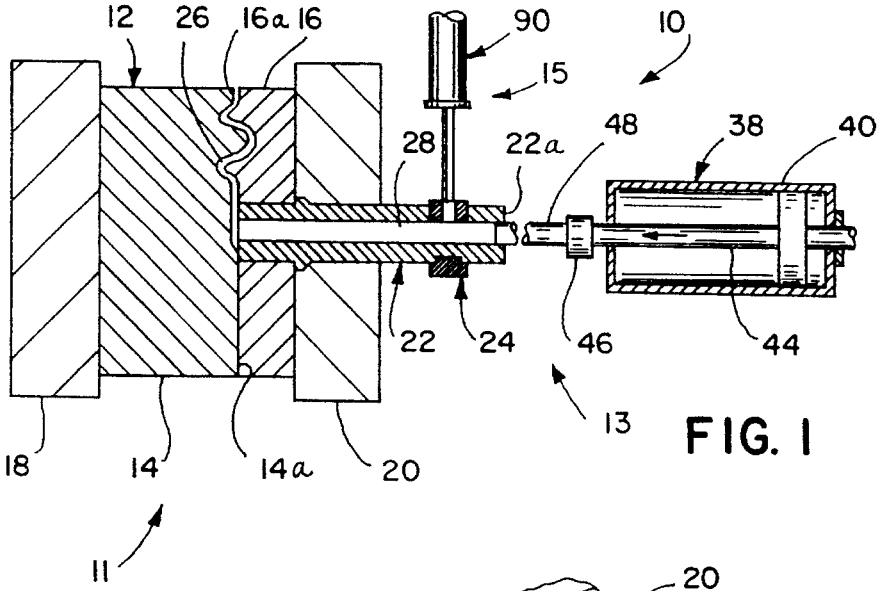
FIG. 1 is a sectional, side elevational view of a die casting apparatus according to the present invention.

By way of disclosure and not by way of limitation, a closed shot die casting apparatus is shown in FIG. 1 and generally designated 10. The apparatus includes a die assembly 11 and a metal delivery system 13. Molten metal is forced from the metal delivery system into the die to create cast metal objects.

Referring to FIG. 1, the die assembly 11 includes a die 12 and platens 18 and 20. The die 12 includes an ejector die 14 mounted to the movable platen 18 and a cover die 16 mounted to the stationary platen 20. The inner surface **14*a* of the ejector die 14 is contoured to match a first portion of the profile of the article to be cast. Similarly, the inner surface 16a of the cover die 16 is contoured to match a second portion of the profile of the article to be cast. When the inner surfaces 14*a* and 16*a* of the ejector and cover dies 14 and 16 are brought together, the contours cooperate to form a void or die cavity 26 which defines the shape of the article to be cast. The movable platen 18 is mounted to conventional hydraulic means (not shown) to provide the ejector die 14** with appropriate movement.

The metal delivery system 13 includes a shot sleeve 22, a drive system 15, and a rotatable closure 24. The shot sleeve 22 is mounted in the stationary platen 20 and the cover die 16 to terminate at die cavity 26. The shot sleeve 22 is generally cylindrical and includes a concentric internal bore 28 that is in fluid communication with the die cavity 26.

Figure 3:
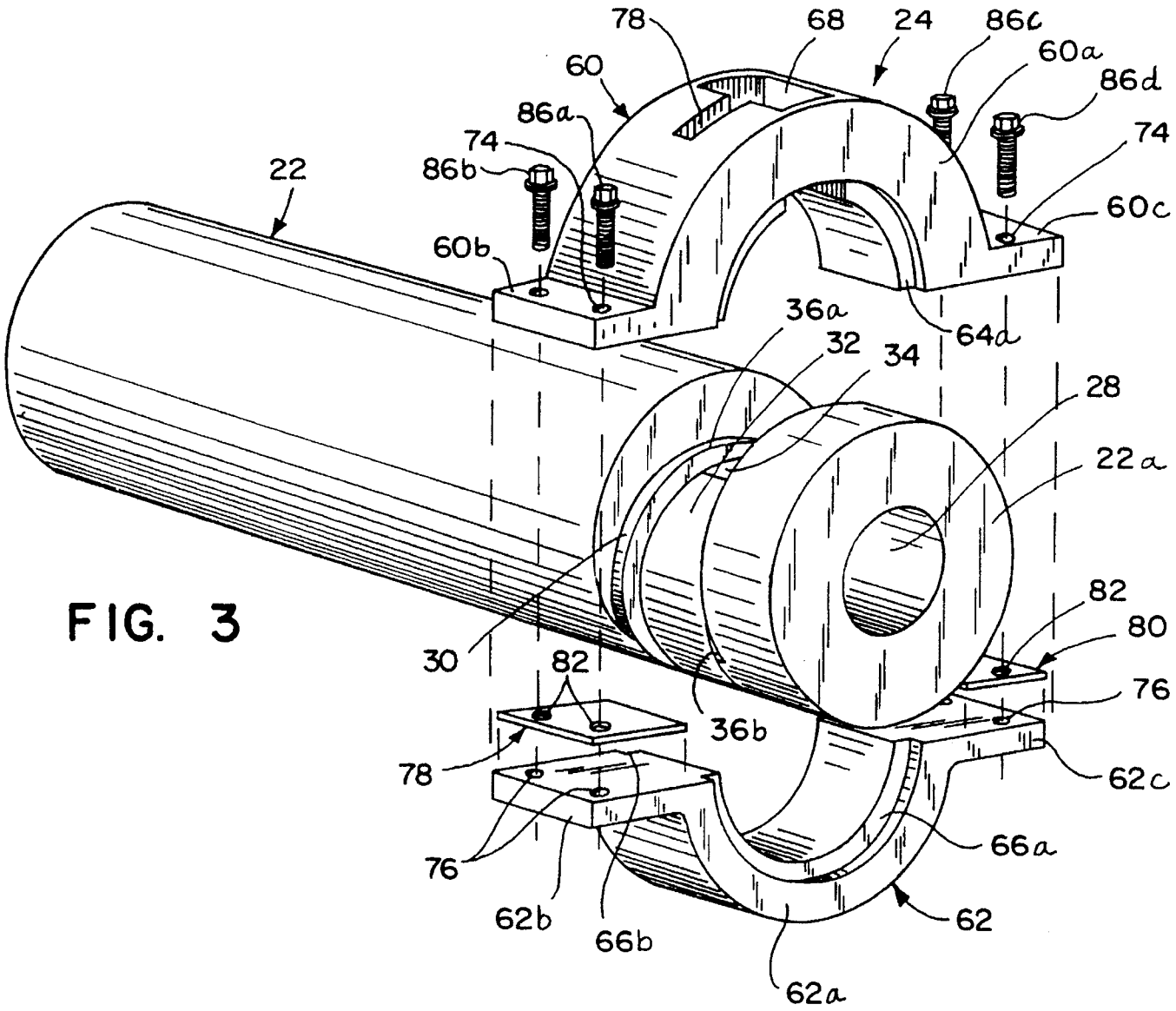
FIG. 3 is an exploded, perspective view of the shot sleeve and closure.
Figure 5:
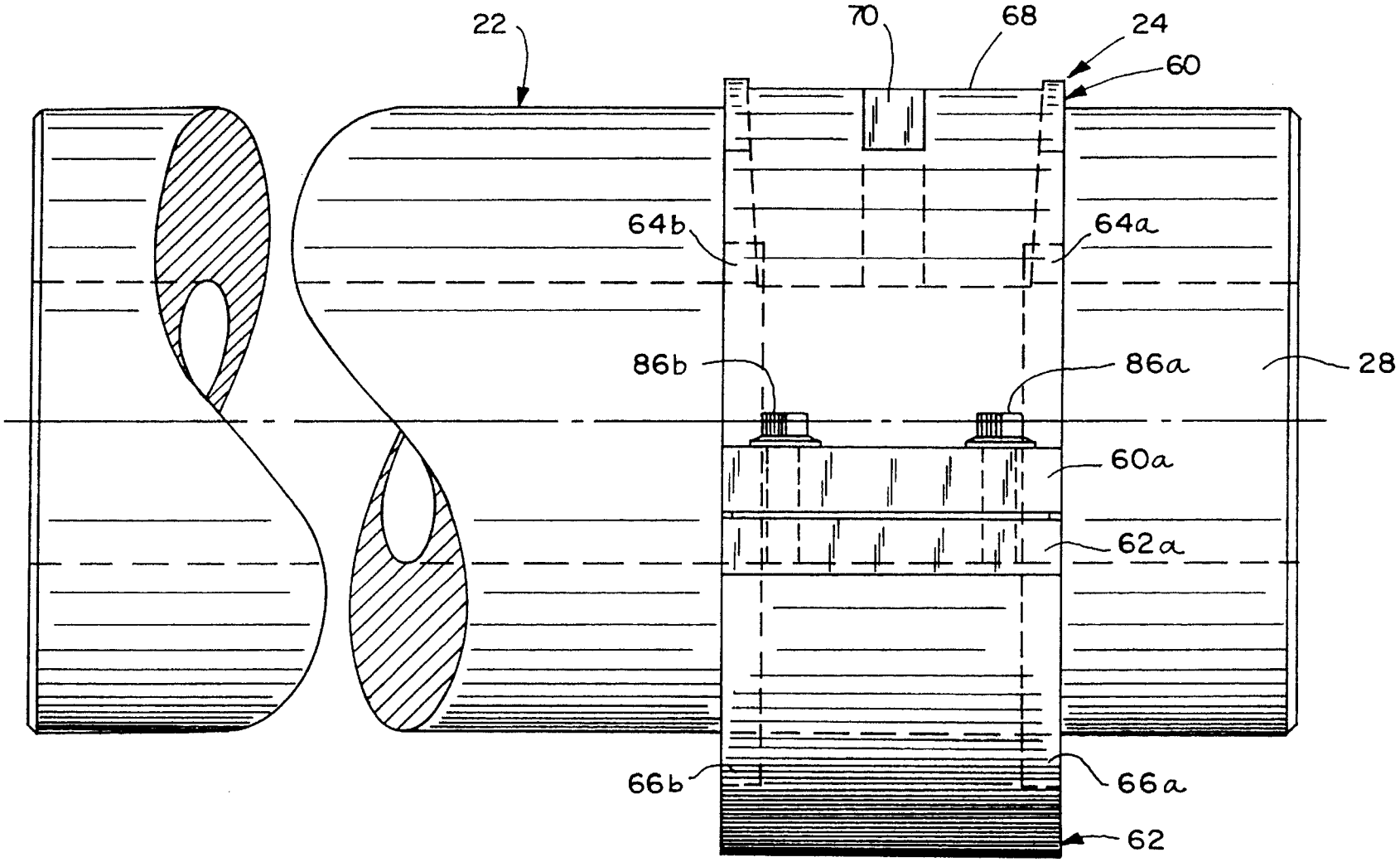
FIG. 5 is a side elevational view of the closure mounted to the shot sleeve.

As perhaps best illustrated in FIG. 3, a first eccentric, annular recess 30 is formed around the shot sleeve 22 near the outer end 22*a*. The first annular recess 30 intersects with the shot sleeve 22 through approximately the upper two thirds of its extent, thereby creating a somewhat quarter-moon shaped void centered upon the upper extreme of the shot sleeve 22.

A second annular recess 32 is formed around the shot sleeve 22 centered upon and in concentric alignment with the first annular recess 30. The second annular recess 32 is narrower and has a smaller diameter than the first annular recess 30. As a result, a pair of ridges 36*a* and 36*b* are formed partially around the shot sleeve at opposite axial ends of the second annular recess 32. The second annular recess 32 intersects with the upper extreme of internal bore 28, thereby forming a filling hole 34 through the upper surface of the shot sleeve 22 in fluid communication with internal bore 28. Preferably, the lower extreme of annular recess 32 coincides with the lower extent of the shot sleeve 22.

Figure 2:
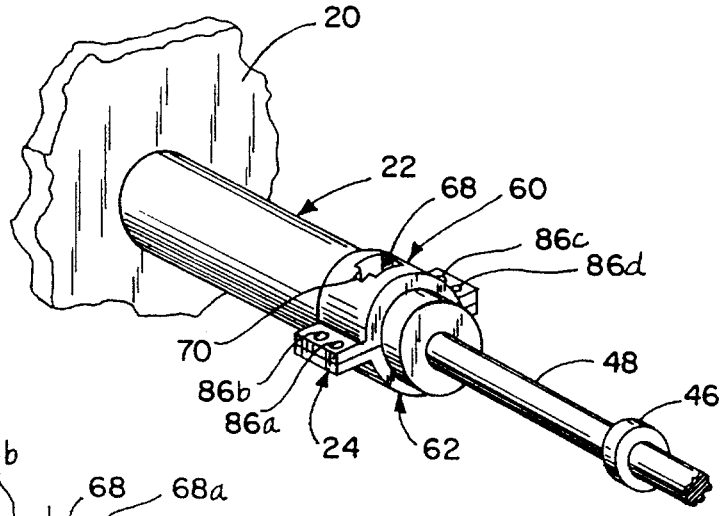
FIG. 2 is a perspective view of a portion of the present invention.
Figure 4:
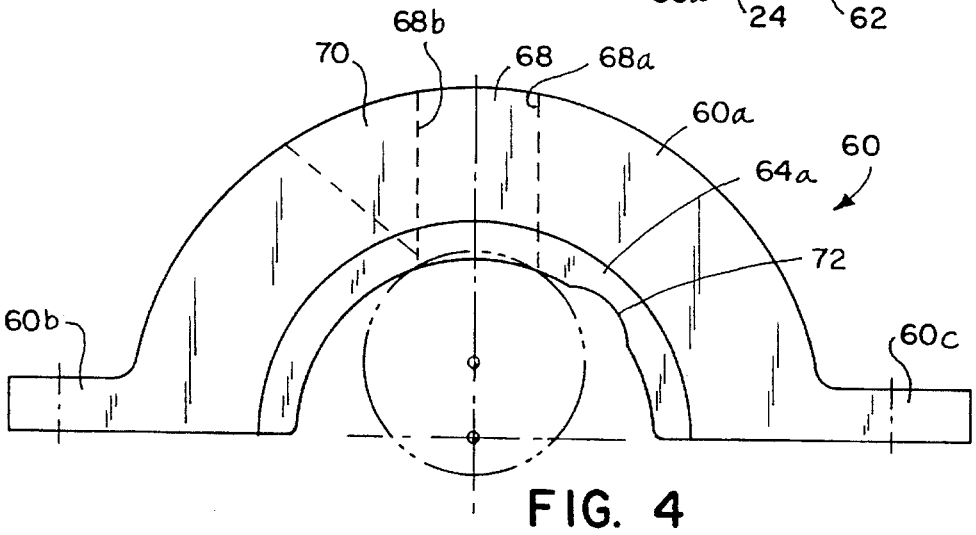
FIG. 4 is front elevational view of the upper closure half.

Referring now to FIGS. 2 and 3, the closure 24 is mounted on the shot sleeve 22 for rotational movement between a fill position and a casting position. As disclosed, the closure 24 rotates approximately 45 degrees between the fill and casting positions. The closure 24 is fabricated of upper and lower C-shaped members 60 and 62 that clamp around the shot sleeve 22 and mate with the profile defined by the first and second annular recesses 30 and 32. The upper and lower members 60 and 62 each include an arcuate portion 60*a* and 62*a* extending between mounting surfaces 60*b*, 60*c* and 62*b*, 62*c*. The inner diameter of each arcuate portion 60*a* and 62*a* is substantially equal to the outer diameter of the eccentric portion of the shot sleeve defined by the second annular recess 32. In addition, a pair of annular notches 64*a*, 64*b* and 66*a*, 66*b* are formed along the inner surface of each closure member 60 and 62 at opposite axial ends thereof. The annular notches 64*a*, 64*b* and 66*a*, 66*b* are dimensioned to mate with the ridges 36*a* and 36*b*.

The upper closure member 60 includes a radially extending pour hole 68 and an overfill trough 70. The pour hole 68 extends through the upper closure member 60 and is aligned or disposed in fluid communication with the filling hole 34 when the closure 24 is in the fill position. The overfill trough 70 is in fluid communication with the pour hole 68 and extends outwardly at an acute angle from the leading wall 68*b* to allow molten material to flow from the pour hole 68.

The upper closure member 60 further defines an axial arcuate recess 72 having a radius of curvature equal to that of the internal bore 28. When the closure member 60 is in the casting position, the arcuate recess 72 is aligned with the bore 28 to allow the plunger rod 48 to reciprocate through the shot sleeve 22. The center of recess 72 is angularly offset from the center of the pour hole 68 by the angular distance between the fill and casting or pour positions. In addition, a pair of mounting holes 74 extend through each mounting surface 60*b* and 60*c*. The lower closure member 62 includes a number of threaded mounting holes 76 aligned with each of mounting holes 74 in the upper closure member 60.

A pair of shims 78 and 80 are sandwiched between the upper and lower closure members 60 and 62. The shims 78 and 80 separate the upper and lower members 60 and 62 to provide sufficient clearance for the closure 24 to rotate around the shot sleeve 22. The shims 78 and 80 each include a pair of mounting holes 82 and 84 to allow the mounting bolts 86*a–d* to pass therethrough.

Figure 7:
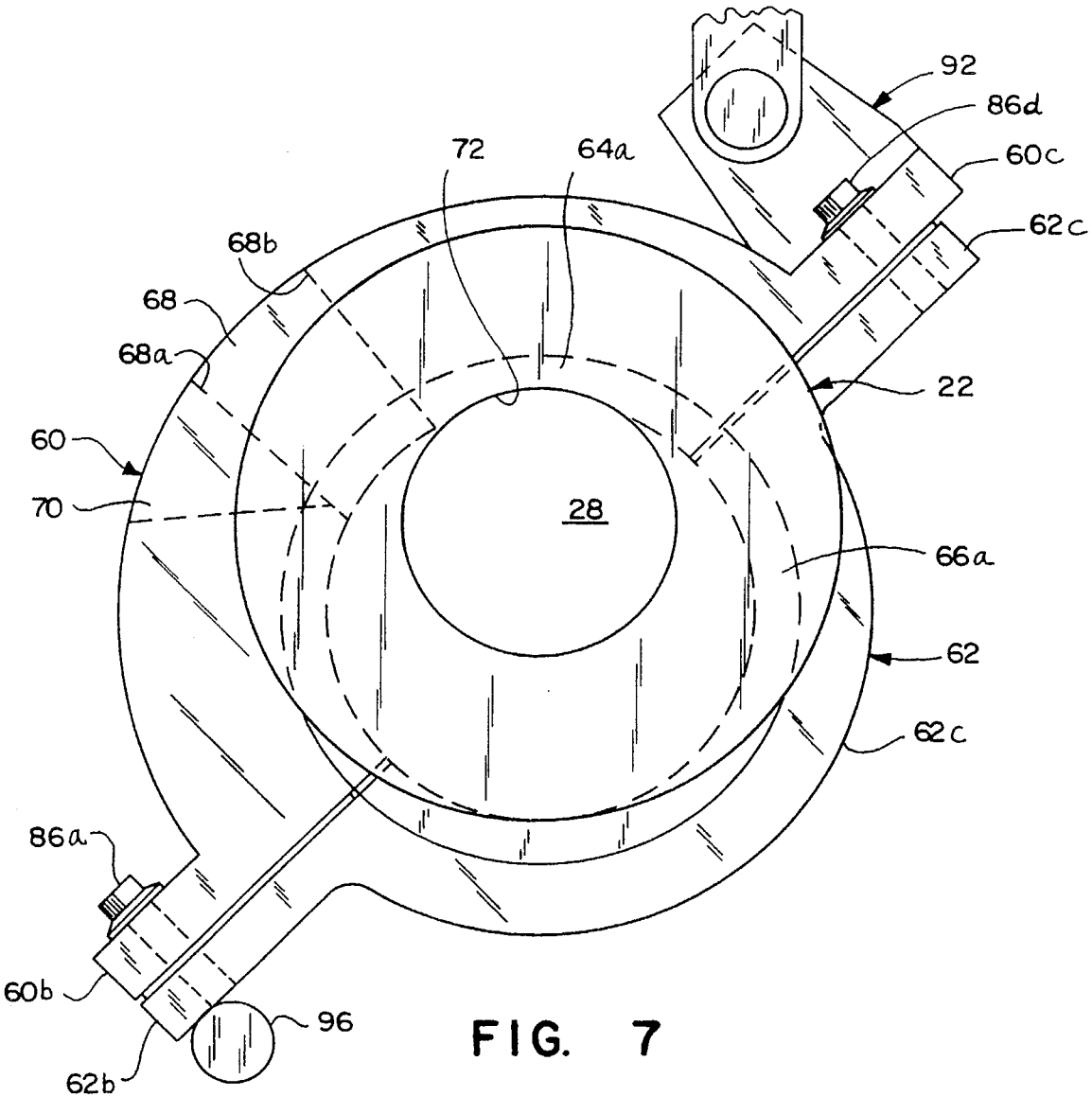
FIG. 7 is a front elevational view of the closure and shot sleeve in the casting or pour position.

As illustrated in FIGS. 1, 6 and 7, a hydraulic cylinder 90 is provided to actuate the closure member 24. The hydraulic cylinder 90 is pivotally mounted to a bracket 92 that is in turn secured to the closure 24 by mounting bolts 86*c* and 86*d*.

Referring now to FIG. 7, a positive stop member 96 prevents overrotation of the closure 24. The positive stop member 96 is preferably mounted adjacent the shot sleeve 24 to abut with mounting surface 62*b* after the filling hole 34 is completely sealed and the excess molten material is poured from the pouring hole 68.

The metal delivery system 13 further includes a hydraulic means 38 for ejecting molten material from the internal bore 28 of the shot sleeve 22 into the die cavity 26. The hydraulic means 38 includes a hydraulic shot cylinder 40, a rod 44, a crosshead adapter 46, and a plunger rod 48. The shot cylinder 40 is aligned with the shot sleeve 22 and operates to provide rod 44 with reciprocating motion. Rod 44 is connected to crosshead adapter 46 and plunger rod 48 to impart reciprocating motion to plunger rod 48. The plunger rod 48 fits snugly within bore 28 so that movement of the rod 48 toward the die 12 will eject the molten material from the shot sleeve 22 into the die cavity 26.

OPERATION

In operation, the appropriately contoured ejector and cover dies 14 and 16 are mounted to movable and stationary platens 18 and 20, respectively. The ejector die 14 is then moved into contact with the cover die 16 to form the die cavity 26. If necessary, hydraulic shot cylinder 40 is retracted to fully withdraw plunger rod 48, as shown in FIG. 1.

Referring now to FIG. 6, the closure 24 is initially in the fill position. Molten metal is poured into the shot sleeve through pour hole 68 until the internal bore 28 of the shot sleeve 22 is filled to overflowing and the overflow partially fills the pour hole 68.

Next, hydraulic cylinder 90 is retracted causing the closure 24 to rotate around the shot sleeve 22. Retraction of the hydraulic cylinder 90 continues until the closure 24 abuts with positive stop member 92. As the closure 24 rotates, the filling hole 34 is gradually sealed off by the inner surface of the upper closure member 60 and the excess molten metal is poured from the pour hole 68 through trough 70 (see FIG. 7). A receptacle (not shown) may be positioned below the shot sleeve 22 to catch any molten metal poured from the rotating closure. When the closure abuts with the positive stop member 90, the filling hole is completely sealed and the excess molten metal is entirely poured form the pour hole 68. In addition, recess 72 is aligned with the internal bore 28 defined in the center of the shot sleeve 22.

Absent trough 70, air may be introduced into the internal bore as the trailing wall 68 of the pour hole 68 rotates below horizontal. The trough 70 prevents air entrainment by eliminating the need to rotate the trailing wall 68a below horizontal. Alternatively, if the pour hole 68 and filling hole 34 are sufficiently narrow, trough 70 may be eliminated because the filling hole 34 will seal prior the point where the trailing wall 68*a* rotates below horizontal.

Once the shot sleeve 22 is filled with molten metal and the closure is rotated into the pour position, the hydraulic shot cylinder 40 is extended to push the plunger rod 48 axially through internal bore 28 in the center of the shot sleeve 22.

The extending plunger rod 48 drives the molten metal from the shot sleeve 22 into the die cavity 26 where it is allowed to cure. Optionally, high pressure may be developed in the molten metal for squeeze casting.

After the article is sufficiently cured, typically through cooling, the ejector die 14 and cover die 16 are separated to provide access to the cast article. The cast article is removed from the die and the die casting apparatus is ready for another operating cycle.

Alternatively, the present invention may operate as a conventional die caster by simply retaining the closure 24 in the fill position during the entire operational cycle. Initially, the plunger rod 48 is in the retracted position and the closure 24 is in the fill position. A desired quantity of molten metal is poured into the shot sleeve 22 and the hydraulic shot cylinder 40 operates to extend plunger rod 48, thereby driving the molten metal from the shot sleeve 22 into the die cavity 26.

The present invention may also operate as a high-speed die caster capable of casting thin-walled articles. The precise timing parameters necessary for high-speed die casting may be determined as a function of the known quantity of molten material contained in the internal bore 28 of the shot sleeve 22.

Further, the present invention is easily retrofitted to existing die casting apparatus, for example, by machining the outer end of the shot sleeve 22*a* with annular recesses 30 and 32, as described above, and affixing a rotary actuated closure 24.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A die casting metal delivery system comprising:

a shot sleeve defining an internal bore and an annular recess eccentric with said bore, said annular recess intersecting said bore to define a filling hole communicating with said bore; and a closure member defining a pour hole, said closure member mounted on said shot sleeve within said annular recess for rotational movement about said shot sleeve between a fill position in which said pour hole is aligned with said filling hole and a casting position in which said filling hole is closed by said closure member.

2. The system of claim 1 wherein said closure member further defines an overfill trough extending from said pour hole, said trough receiving overfill molten metal when said closure member is in said fill position and whereupon movement of said closure member from said fill position to said casting position pours any molten metal from said overfill trough.

3. The system of claim 1 wherein said closure member defines an axial, arcuate recess that aligns with said internal bore of said shot sleeve when said closure member is in said casting position, said recess having a radius of curvature substantially equal to that of said internal bore.

4. A die casting apparatus comprising:

a die having a die cavity;

a shot sleeve having an internal bore in fluid communication with said die cavity, said shot sleeve defining an annular recess eccentric with said internal bore, said annular recess intersecting said internal bore to define a filling hole in communication with said internal bore; and a closure mounted on said shot sleeve within said annular recess, said closure defining a pour hole and being movable between a fill position in which said pour hole is in fluid communication with said filling hole and a casting position in which said pour hole and said filling hole are not in fluid communication.

5. The die casting apparatus of claim 4 wherein said closure closes said filling hole when said closure is in the casting position.

6. The die casting apparatus of claim 4 wherein said closure further defines an overfill trough communicating with said pour hole for pouring molten material from said pour hole as said closure is moved from the fill position to the casting position.

7. The die casting apparatus of claim 4, wherein said closure defines an axial, arcuate recess aligned with said bore of said shot sleeve when said closure is in said casting position, said recess having a radius of curvature substantially equal to that of said bore.

8. The die casting apparatus of claim 4 further comprising drive means for moving said closure between the fill position and the casting position.

9. An apparatus for injecting a shot of molten material into the cavity of a die comprising:

a shot sleeve defining an internal bore adapted to be in fluid communication with the die cavity, said sleeve further defining a filling hole in communication with said internal bore, said sleeve further defining an annular recess eccentric with said bore, said annular recess intersecting with said internal bore, said filling hole being defined by the intersection of said annular recess with said internal bore;

a plunger mounted for reciprocating motion within said internal bore;

drive means for driving said plunger;

a closure mounted on said shot sleeve within said annular recess, said closure defining a pour hole, said closure being movable between a fill position in which said pour hole is in fluid communication with said filling hole, and a casting position in which said closure covers said filling hole, said closure defining an arcuate recess which aligns with said internal bore of said shot sleeve when said closure is in the casting position; and drive means for rotating said closure between the fill position and the casting position.

10. The apparatus of claim 9 wherein said closure further defines an overfill trough communicating with said pour hole for pouring molten material from said pour hole when said closure is moved to said casting position.

11. A method for closed shot die casting, comprising:

providing a shot sleeve having an axial internal bore in fluid communication with the cavity of a die and an annular recess eccentric with the internal bore, the annular recess intersecting the internal bore to define a filling hole in fluid communication with the internal bore;

providing a rotary actuated closure eccentrically mounted to the shot sleeve within the annular recess for rotational movement between a fill position and a casting position, the closure having a pour hole in fluid communication with the filling hole when in the fill position, the closure sealing the filling hole when in the casting position;

rotating the closure into the fill position;

introducing molten material into the internal bore of the shot sleeve through the pour hole and filling hole until molten material fills the internal bore and excess molten material partially fills the pour hole;

rotating the closure into the casting position to seal the filling hole and pour the excess molten material from the pour hole; and advancing a plunger within the internal bore of the shot sleeve to inject the molten material into the cavity of the die.

* * * * *